United States Patent [19]

Budelman

[11] 4,409,877

[45] Oct. 18, 1983

[54] ELECTRONIC TONE GENERATING SYSTEM

[75] Inventor: Gerald A. Budelman, Aloha, Oreg.

[73] Assignee: CBS, Inc., New York, N.Y.

[21] Appl. No.: 283,355

[22] Filed: Jul. 14, 1981

Related U.S. Application Data

[63] Continuation of Ser. No. 47,364, Jun. 11, 1979, abandoned.

[51] Int. Cl.[3] ..... G10B 3/10; G10H 1/08; G10H 7/00

[52] U.S. Cl. ..... 84/1.23; 84/345

[58] Field of Search ..... 84/1.01, 1.11, 1.12, 84/1.17, 1.19, 1.21–1.24, 345

[56] References Cited

U.S. PATENT DOCUMENTS

| | | | |
|---|---|---|---|
| Re. 21,137 | 7/1939 | Firestone | 84/1.17 |
| Re. 30,736 | 9/1981 | Hiyoshi et al. | 84/1.11 |
| 1,705,395 | 3/1929 | Cabot | 84/1.12 |
| 1,733,630 | 10/1929 | Severy | 84/1.12 |
| 1,956,350 | 4/1934 | Hammond | 84/1.17 |
| 2,159,505 | 5/1939 | Hammond | 84/1.21 |
| 2,251,051 | 7/1941 | Hammond | 84/1.21 |
| 3,041,910 | 7/1962 | Leslie | 84/1.22 |
| 3,046,826 | 7/1962 | Kramer | 84/1.11 |
| 3,327,043 | 6/1967 | Martin | 84/1.01 |
| 3,347,973 | 10/1967 | Freeman | 84/1.24 |
| 3,499,090 | 3/1970 | Meyer | 84/1.01 |
| 3,538,805 | 11/1970 | Uetrecht | 84/1.11 |
| 3,636,231 | 1/1972 | Schrecongost et al. | 84/1.23 |
| 3,702,370 | 11/1972 | Hallman, Jr. | 84/1.01 |
| 3,733,593 | 5/1973 | Molnar | 84/1.01 X |
| 3,764,721 | 10/1973 | Maynard | 84/1.24 |
| 3,775,545 | 11/1973 | Tsukamoto et al. | 84/1.01 |
| 3,809,786 | 5/1974 | Deutsch | 84/1.01 |
| 3,816,635 | 6/1974 | Uetrecht | 84/1.01 |
| 3,821,460 | 6/1974 | Maynard | 84/1.17 |
| 3,823,390 | 7/1974 | Tomisawa et al. | 84/1.01 X |
| 3,828,109 | 8/1974 | Morez | 84/1.01 |
| 3,882,751 | 5/1975 | Tomisawa et al. | 84/1.01 |
| 3,890,602 | 6/1975 | Tomisawa et al. . | |
| 3,926,087 | 12/1975 | Griffis | 84/345 |
| 3,939,751 | 2/1976 | Harasek | 84/1.17 |
| 3,943,814 | 3/1976 | Wemekamp | 84/1.01 |
| 3,978,755 | 9/1976 | Woron | 84/1.24 |
| 3,992,971 | 11/1976 | Chibana et al. | 84/1.11 |
| 4,006,658 | 2/1977 | Kappes et al. | 84/345 |
| 4,077,294 | 3/1978 | Hiyoshi et al. | 84/1.23 |
| 4,137,810 | 2/1979 | Wheelwright et al. | 84/1.22 X |

*Primary Examiner*—Stanley J. Witkowski

*Attorney, Agent, or Firm*—Klarquist, Sparkman, Campbell, Leigh, Winston & Dellett

[57] ABSTRACT

A tone generating system for an organ comprises a first group of tone generators for producing notes of a first chromatic scale and second group of tone generators for producing notes of a second chromatic scale, slightly offset from the first. The tone generators are addressed via a microprocessor in response to keyboard input, wherein the fundamental and a first plurality of selected harmonic components of a given note are generated by respective tone generators of said first group, and the remaining harmonics are provided by generators of the second group. Harmonic amplitude coefficients for particular organ waveforms are stored in random access memory and are subject to change according to stop inputs coupled to the microprocessor.

48 Claims, 10 Drawing Figures

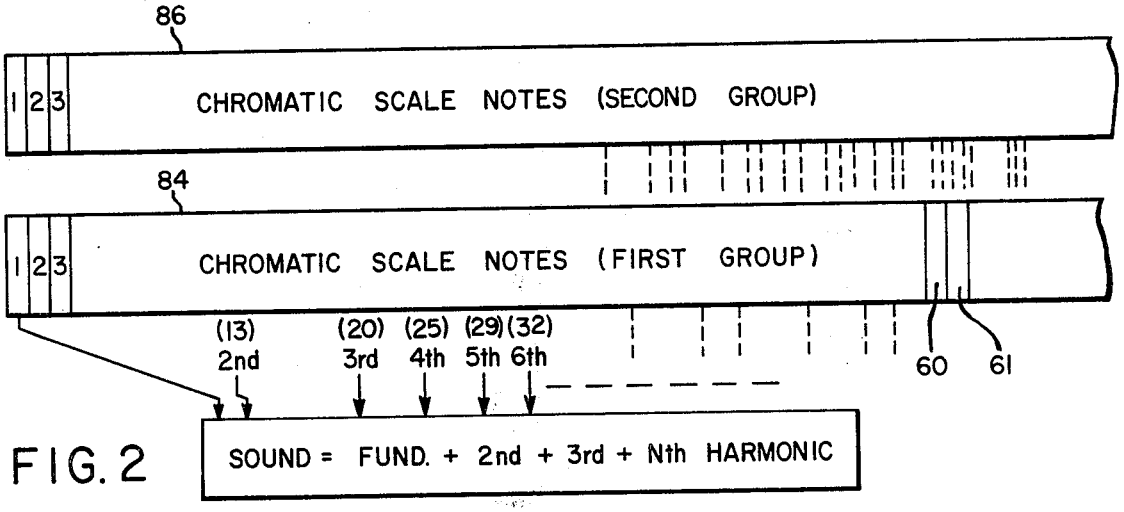
FIG. 2
FIG. 3
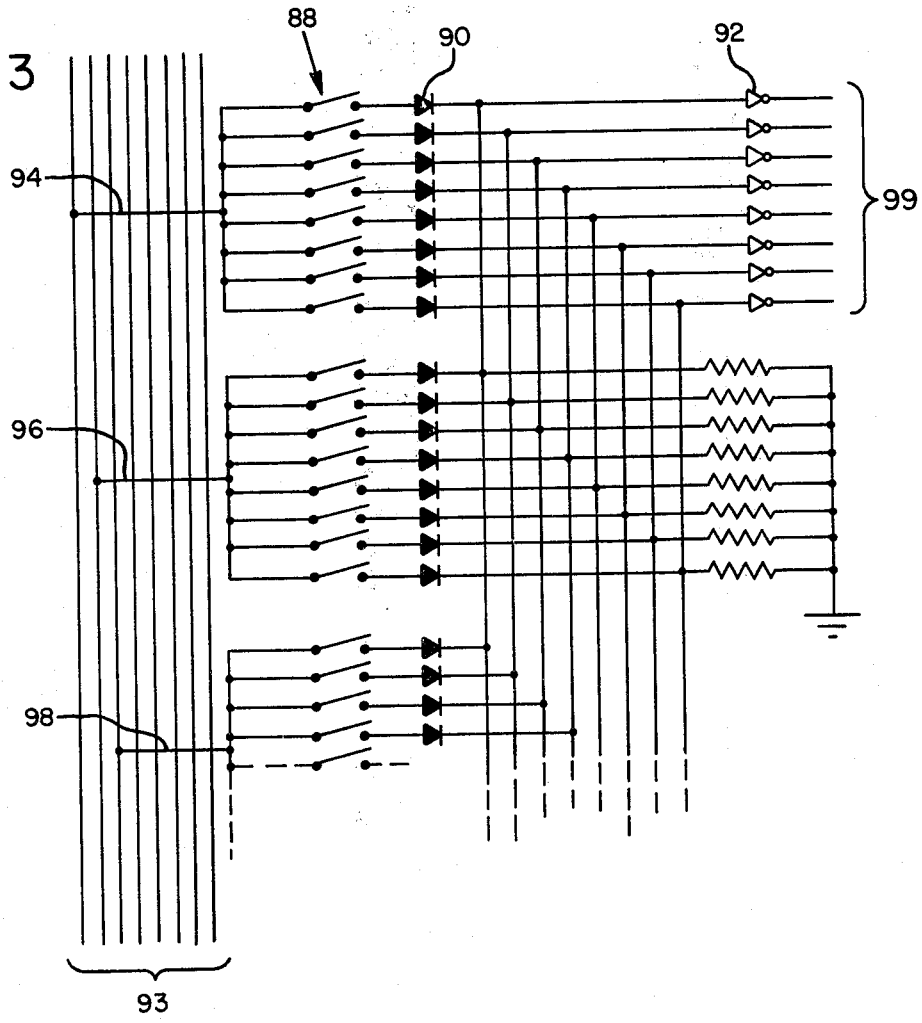

FIG. 4
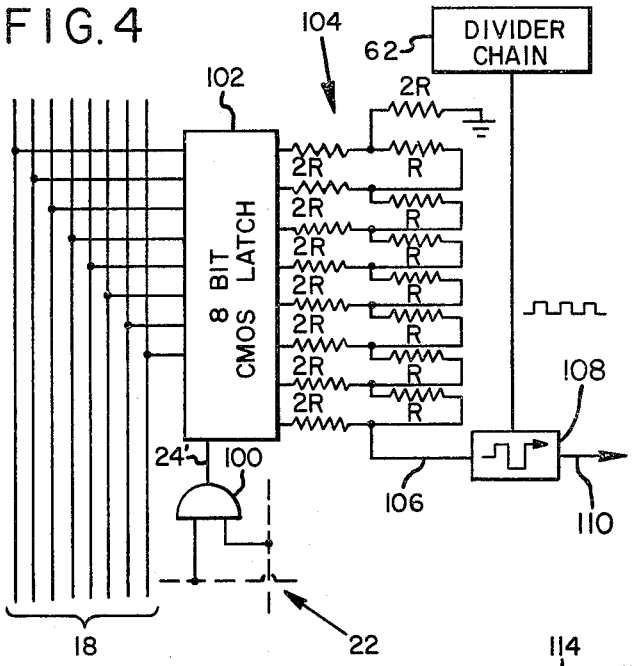
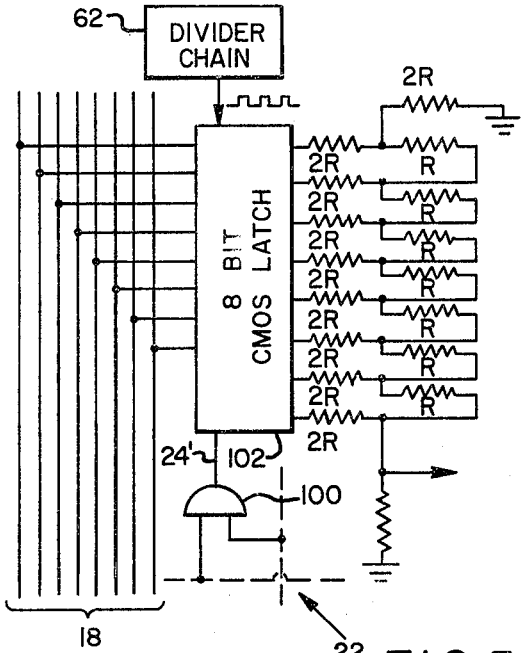
FIG. 5
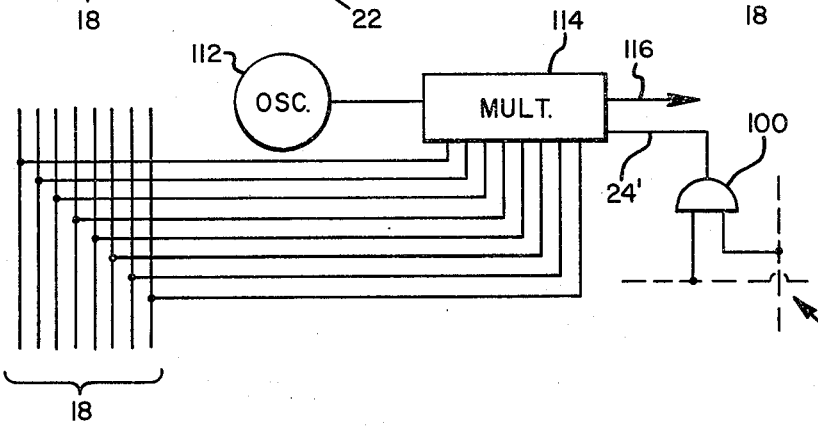
FIG. 6
FIG. 7
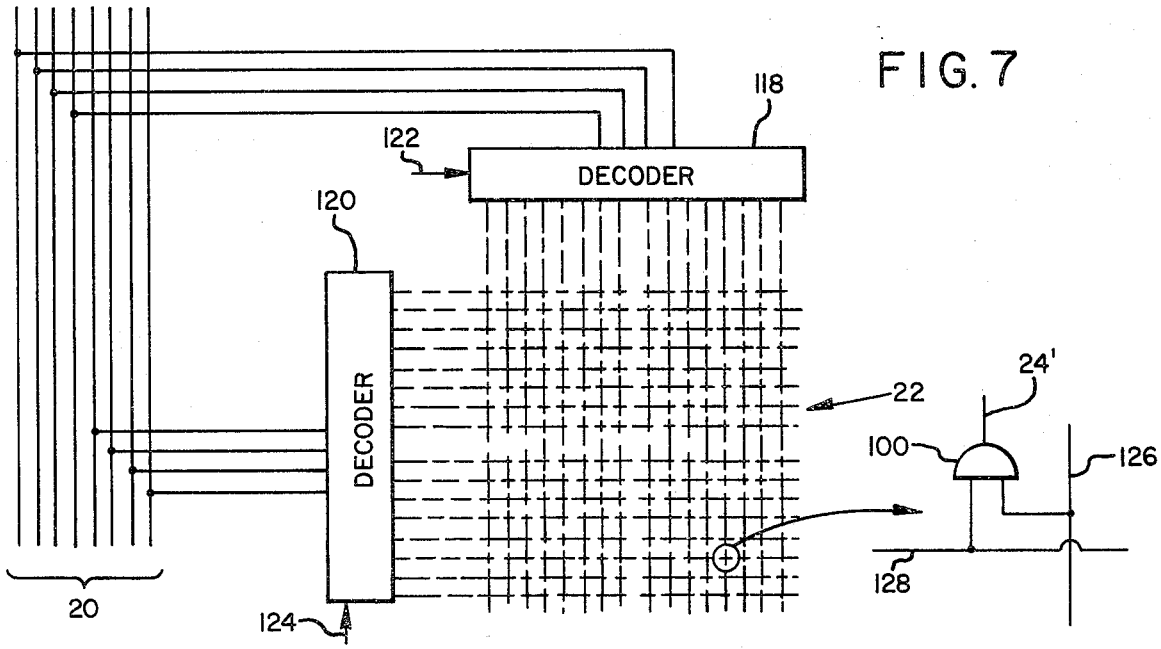

ELECTRONIC TONE GENERATING SYSTEM

This is a continuation of application Ser. No. 047,364, filed June 11, 1979, and now abandoned.

BACKGROUND OF THE INVENTION

The present invention relates to an electronic tone generating system and particularly to such a system for reproducing organ tones having improved harmonic content.

Electronic tone generation as employed in electronic organs typically simulates the musical sound produced by a pipe organ, within reasonable cost constraints placed on the instrument. Each note on each organ manual may be generated by an electronic oscillator the output of which is modified by stop-controlled wave shaping circuitry to resemble a pipe organ waveform. Divider chains can be utilized to reduce the number of oscillators necessary. Other organ systems include computer circuitry for calculating elemental samples of a complex musical waveform and/or storing the same in memory from which the samples are retrieved at a rate proportional to the frequency or pitch of the desired output.

At least in principle, individual tone generator circuits are not required for the generation of each complex organ output wave shape. Instead, oscillators could generate sine wave components for additive combination into complex waveforms. Unfortunately, the exact generation of all the harmonics for all the notes on an organ would require an impractically large number of individual sine wave generators. Heretofore, organ systems using this type of approach have relied for harmonic generation on the higher frequency note generators in the same musical scale as the selected fundamental. Thus, the second harmonic of any given note is the corresponding note in the next octave up the scale, the fourth harmonic is two octaves up, the eighth is three octaves up, etc., while close correspondence may also be found on the musical scale for other harmonics such as the third, fifth and sixth. However, reproduction is usually limited to the first few lower order harmonics because of the divergence between many of the higher harmonics and higher notes on the scale. A good reproduction of pipe organ tones, on the other hand, requires a much larger number of harmonics.

SUMMARY OF THE INVENTION

According to the present invention, in a principal embodiment thereof, an electronic tone generating system includes a first group of tone generators having output frequencies defining a first musical scale, and a second group of tone generators having output frequencies defining a second musical scale offset with respect to the first. The first group of tone generators is responsive to a keyboard operation, e.g. the actuation of a particular key, for generating the fundamental of the desired musical note as well as a first set of harmonic output frequencies. The second group of tone generators is responsive to the same keyboard operation for reproducing a second set of harmonic output frequencies substituting for selected harmonic frequencies of the first set as fall outside predetermined error limits. In the disclosed example, a generator output is considered satisfactory if it is within eighteen cents of the exact harmonic value, wherein one hundred cents defines the spacing between notes on the scale.

In the foregoing manner, pipe organ voices can be reproduced with considerable accuracy, without inordinately increasing the number of tone generators in the system. The tone generators of the second group need not be as numerous as the first inasmuch as generators at the lower end of the scale are not required, i.e. they would not represent higher harmonics of any scale note. At the same time, the second group of tone generators need not generate tones appreciably higher in frequency than the tones of the first scale since they would extend beyond the audible range. In the particular embodiment described herein, simulating pipe organ sound with thirty-two harmonics and two scales, the second musical scale is flat by approximately forty-three cents as compared with the first musical scale. The harmonics selected for reproduction by tone generators of the second scale, in such case, are harmonics numbered seven, eleven, thirteen, fourteen, twenty-one, twenty-two, twenty-five, twenty-six, twenty-eight and thirty-one. As will hereinafter become evident substantially the same pattern of tone generators is utilized in producing the harmonic structure of any given note, no matter where the note is located along the scale. Thus, the second harmonic is provided by the thirteenth tone generator higher in frequency than the fundamental in the first group, the thirty-fifth tone generator up the scale in the second group is employed for the seventh harmonic, and so on.

In accordance with another feature of the present invention, a computer, and specifically a microprocessor, is programmed to operate tone generators of a group of tone generators according to the desired harmonic content of a note represented by a key depressed on a keyboard. The computer is also responsive to a plurality of stops and stores harmonic amplitude coefficients in memory in response to the actuation of certain stops. If an additional stop is actuated, harmonic amplitude values corresponding to the tonal quality selected by the additional stop are added to the harmonic amplitude coefficients already stored in memory. The resultant amplitude coefficients are accessed for determining the amplitude outputs for the various tone generators directed to reproduce a selected voice.

It is accordingly an object of the present invention to provide an improved electronic tone generating system capable of reproducing a wide variety of tonal variations.

It is another object of the present invention to provide an improved tone generating system for an organ, which system employs a plurality of relatively simple tone generators.

It is a further object of the present invention to provide an improved tone generating system for economically producing a wide variety of tonal combinations from individual harmonic components.

It is another object of the present invention to provide an improved electronic tone generating system utilizing outputs of tone generators distributed along a scale for producing harmonic components wherein a greater number of higher frequency harmonic components are provided.

It is a further object of the present invention to provide an improved computer-operated tone generating system including a plurality of analog tone generators digitally selected in accordance with computer input.

It is another object of the present invention to provide an improved digital-to-analog converter as a tone generator.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

FIG. 2 is an explanatory diagram illustrating musical scales generated by separate groups of tone generators in FIG. 1;

FIG. 3 is a schematic diagram of an input network employed for scanning keyboad switches;

FIG. 4 is a schematic diagram of a first embodiment of a tone generator according to the present invention;

FIG. 5 is a schematic diagram of a second and preferred type of tone generator;

FIG. 6 is a schematic diagram of a third type of tone generator;

FIG. 7 is a schematic diagram of an address matrix employed to address tone generators;

DETAILED DESCRIPTION

Figure 1:
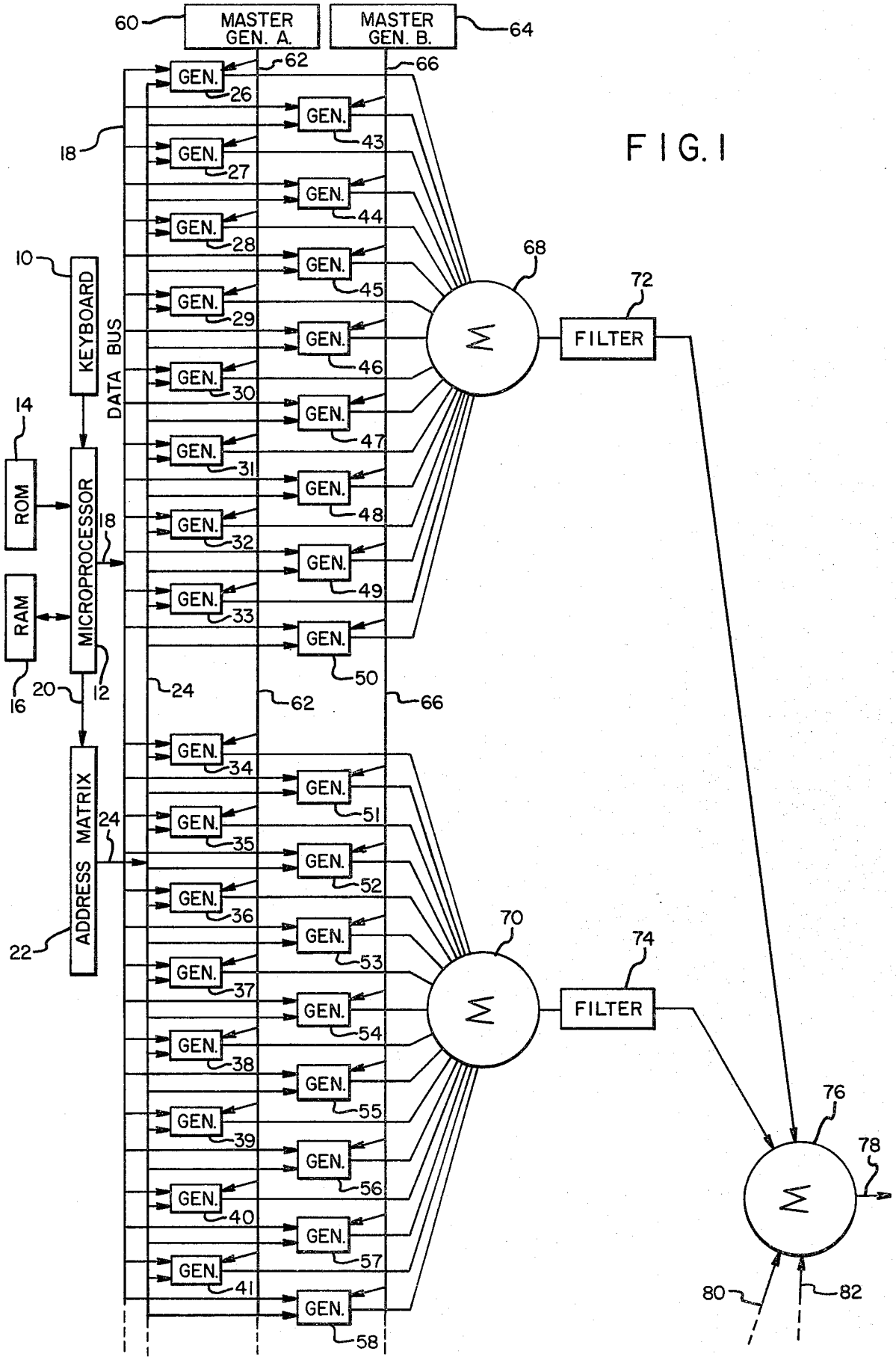
FIG. 1 is a block diagram of a tone generating system according to the present invention.

Referring to the drawings and particularly to FIG. 1, an electronic tone generating system according to the present invention, suitable for use in an organ, includes a keyboard 10 providing an input to microprocessor 12. The keyboard input 10 in the illustrated example comprises two or more manuals and a pedal board, as well as a plurality of stops and controls, but it is understood alternative types of keyboard arrangements may be employed. Microprocessor 12 is suitably a Zilog model Z-80 central processing unit intercoupled with read only memory 14 and random access memory 16. The read only memory in the present example has a capacity of 4K eight bit bytes, while random access memory 16 has a capacity of 2K eight bit bytes. The read only memory stores harmonic amplitude coefficients representing the harmonic content of musical waveforms, as will be selected by the organ stop tabs, and stores the program for the processor. The random access memory stores the last state of all input lines, i.e. key and stop positions, so that a detection of input change can be made, and also stores the conditions of all tone generators.

The random access memory further acts as a voicing memory storing typically 32 bytes of harmonic information for each division of the organ, e.g. the swell, great and pedal divisions. In each case these 32 bytes respectively represent the envelope amplitudes of 32 fundamental and harmonic components for a tonal quality selected for the individual division of the stop tabs. When a stop tab is actuated, the microprocessor 12 reads the values for the harmonic components corresponding to that stop, as found in read only memory 14, and adds the same to corresponding values for other actuated stops, preferably in RMS fashion, and the result is stored for later access in the appropriate voicing section in random access memory 16. This information is then read by the microprocessor in response to depression of a key on keyboard 10.

Voicing information comprising waveform envelope amplitude values for various harmonic components is delivered to data bus 18 by the microprocessor for supplying inputs to a first group of tone generators, 26 through 41, and a second group of tone generators, 43 through 58. Each tone generator in the first group in effect provides an output of only one given frequency, i.e., the fundamental frequency corresponding to a respective note in an equal tempered chromatic scale. In the drawing, only sixteen tone generators are illustrated in the first group, but it is understood approximately one hundred nine such generators can be employed to represent the entire scale for an organ. The first twelve generators, 26 through 37, represent the first or top octave, while generators 38 through 41 represent part of the next octave, and so on. The tone generators can comprise individual oscillators, the outputs of which are proportionally enabled according to the operation of microprocessor 18, or may comprise digital means as hereinafter more fully described. Microprocessor 12 drives an address bus 20 connected to and address matrix 22 supplying decoded strobe outputs at 24 operative to select various tone generators. In effect, the output 24 comprises an extension of the address bus for addressing individual tone generators 26 through 41.

In the simplest case, if the tone generating system of FIG. 1 were to provide only sine wave outputs representative of the various notes selected on keyboard 10, without harmonics or overtones, the appropriate generator, 26 through 41, would be selected via address bus extension 24 in accordance with a key depressed on keyboard 10, with the tone amplitude being controlled from data bus 18. The outputs of the generators are collected via summing circuits 68 and 70, and coupled through filters 72 and 74 to a final summing circuit 76 supplying an output at 78 appropriate for actuating an audio reproduction apparatus such as a loud speaker or the like. In the system according to FIG. 1, the fundamental of a note selected by a keyboard key is generated substantially in this manner. Harmonics are then added to the output for a given note by selecting other generators up the scale, via address bus extension 24, and each such harmonic waveform is given an appropriate envelope amplitude by means of the value applied to that generator on data bus 18. The second harmonic is obtained from the generator corresponding to the same note in the next octave up, the fourth harmonic is provided from the second octave, the eighth harmonic from the third octave, and so on. Intermediate harmonics, such as the third, fifth, etc., are provided through operation of intermediately positioned generators as will hereinafter become more evident.

While the individual oscillators 26 through 41 can be individual sine wave generators, it is preferred to employ a master or top octave generator 60 coupled via bus 62 to the respective generators 26 through 41 along the scale, whereupon the latter generators become gating circuits or modulators for passing predetermined envelope amplitude outputs corresponding to the desired fundamental or harmonic component. Generator 60 supplies twelve frequencies for scale generators 26 through 37, and divided-down frequencies for the rest of the scale in a conventional manner. The scale generators 26–41 are preferably digitally operated and master generator 60 comprises a source of square waves at the appropriate frequency for "chopping" the scale generator outputs. The outputs of the scale generators are thus harmonic rich, e.g., they comprise square waves of appropriate frequency each having an envelope amplitude determined according to the input derived from data bus 18, which is in accordance with the amplitude of the harmonic which that scale generator is selected to produce.

Figure 10:
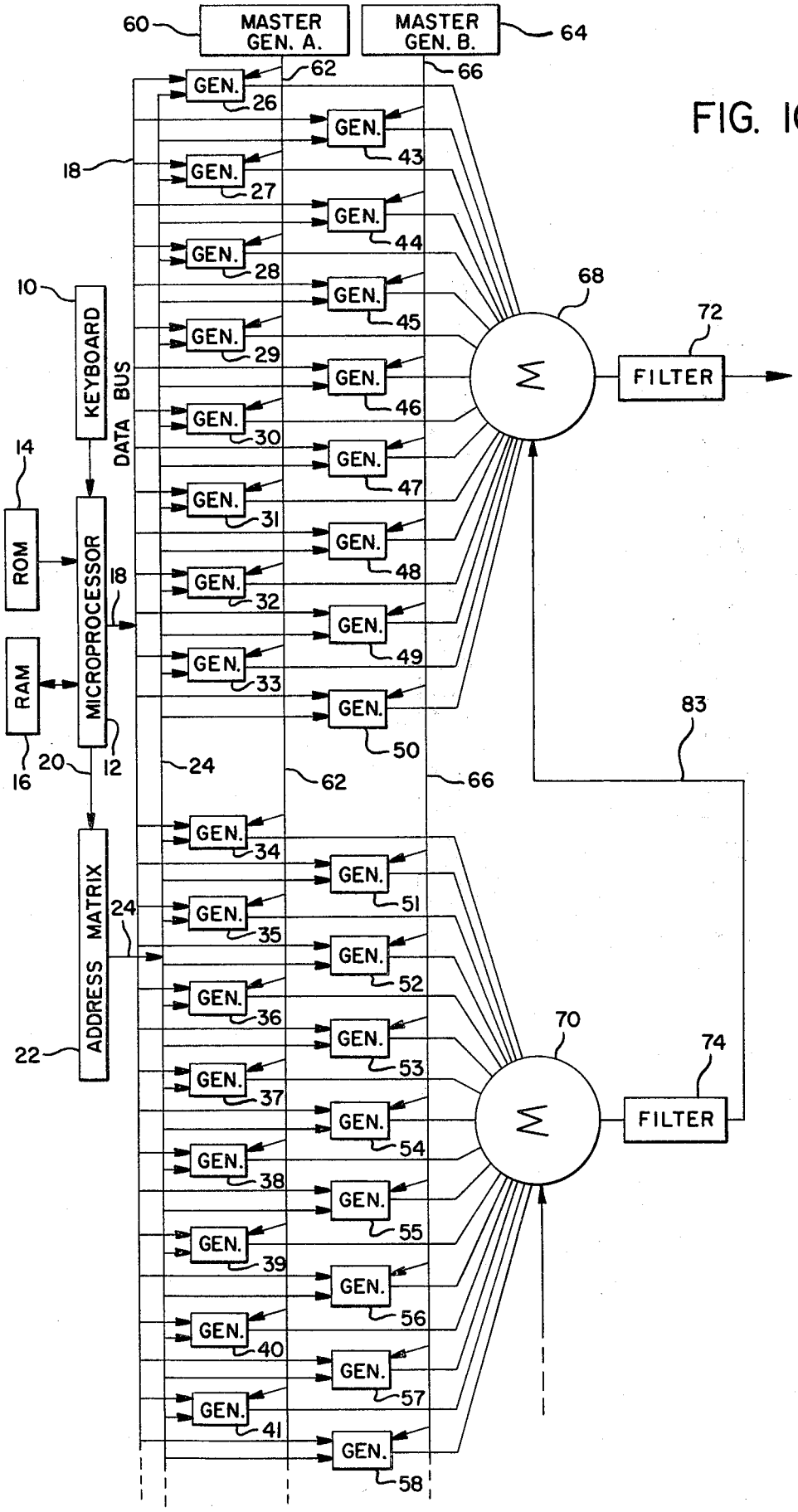
FIG. 10 is a block diagram of a tone generating system according to an alternative embodiment of the present invention.

It will be observed the generators are divided into sub groups 26–33 and 34–41 having their outputs connected in driving relation to separate summing circuits 68 and 70. The summing circuit 68, which comprises an operational amplifier with appropriate input connections, drives an active filter 72. Similarly, summing circuit 70 in the form of an operational amplifier drives active filter 74, wherein the outputs of filters 72 and 74 as well as the outputs from other sub groups of scale generators, as indicated at 80 and 82, are summed by summing circuit 76, the latter also comprising an operational amplifier. The outputs from the generators of each sub group are square waves, and the higher frequency components thereof are removed by the filters 72 and 74, each comprising a six pole Chebyshev filter in the present embodiment. Each of the filters 72 and 74 is a low pass filter having a cutoff frequency above the highest fundamental frequency provided by generators in the sub group, but low enough to filter out the third harmonic of any such generator, the third harmonic being the first spurious harmonic produced according to the particular harmonic rich square wave generator outputs. The sine wave components after filtering retain the properly assigned envelope amplitudes, or will make corresponding amplitude contributions to a combined waveform. Rather than coupling the outputs of filters 72, 74, etc., with the same summing circuit 76, it is desirable according to the alternative embodiment of FIG. 10 to couple the output of filter 74 to an input of summing circuit 68 as indicated at 83, and so on along the scale, with the output of the filter 72 being supplied to audio reproduction means. The latter arrangement provides additional roll-off of unwanted higher order components, and reduces system noise.

The system as thus far described can advantageously supply the fundamental and approximately the first six harmonics for any given note selected on the keyboard. Referring to FIG. 2, a chromatic scale of notes is indicated at 84 for sixty-one notes, and corresponds to the first group of generators in FIG. 1. Assuming the lowest note of the scale is to be reproduced, i.e., note one, an appropriate organ sound is synthesized with a first generator providing the fundamental, the thirteenth generator up the scale providing the second harmonic (i.e. one octave up), the twentieth note generator up the scale supplying the third harmonic, etc., as indicated in FIG. 2. The twentieth, twenty-fifth, twenty-ninth and thirty-second note generators are appropriate for simulating the third, fourth, fifth and sixth harmonics respectively since the output of these note generators differ from the exact harmonics by only a few cents. However, the seventh harmonic and various other higher harmonics are not obtainable from higher frequency note generators in the scale represented at 84. While it would be possible to provide a large enough number of note generators to supply all the desired harmonics for every note on the organ keyboard, such a solution is extremely impractical. Furthermore, just employing the first few harmonics does not effectively simulate a pipe organ tone, since approximately 32 harmonics are desirable. According to the present invention, a second group of generators, 43 through 58 in FIG. 1, is structured according to a second musical scale, preferably a second equal tempered chromatic scale, offset with respect to the first chromatic scale 84 in FIG. 2. The second chromatic scale is indicated at 86 in FIG. 2. The second chromatic scale is offset by a number of cents less than the spacing between notes on a scale, i.e. less than one hundred cents. In the specific embodiment, the second chromatic scale 86 is selected to be flat by approximately forty-three cents. For complete note generation, harmonics 7, 11, 13, 14, 21, 22, 25, 26, 28 and 31 for any note are obtained from the second scale, i.e., from the second group of note generators, assuming such harmonics are audible. In each case, selection of these harmonics from the second scale reduces the error since the required harmonics are a few cents flat from the first scale 84, except for harmonics 13, 26 and 31 where the closest note will be the next higher note on the second scale. In general, however, corresponding harmonics are derived from scale 86 at substantially the same generator positions as they would have been derived less accurately from scale 84. Harmonics 23 and 29 can be derived from either scale, or eliminated entirely because of the error represented thereby. The remaining harmonics are, of course, derived from the original scale 84. There follows a table representing the error in harmonic selection for the first thirty-two harmonics, if all harmonics had been obtained from scale 84, and the correction obtained in specified instances with a second scale 86 which is forty-three cents flat. In each case, the number indicates the difference in cents between a given harmonic, 1 through 32, and the nearest available pitch on the chromatic scale.

TABLE I

| Harmonic | Error in Harmonic From Nearest Pitch in First Group (Cents) | Error in Selected Harmonic from Nearest Pitch in Second Group (Cents) |
|---|---|---|
| 2 | 0 | — |
| 3 | 1.90 | — |
| 4 | 0 | — |
| 5 | −13.24 | — |
| 6 | 1.90 | — |
| 7 | −30.01 | 12.99 |
| 8 | 0 | — |
| 9 | 3.80 | — |
| 10 | −13.24 | — |
| 11 | −46.63 | −3.63 |
| 12 | 1.90 | — |
| 13 | 39.83 | −17.17 |
| 14 | −30.01 | 12.99 |
| 15 | −11.36 | — |
| 16 | 0 | — |
| 17 | 4.82 | — |
| 18 | 3.80 | — |
| 19 | −2.41 | — |
| 20 | −13.24 | — |
| 21 | −28.15 | 14.85 |
| 22 | −46.63 | −3.63 |
| 23 | 27.69 | — |
| 24 | 1.90 | — |
| 25 | −26.38 | 16.62 |
| 26 | 39.83 | −17.17 |
| 27 | 5.71 | — |
| 28 | −30.01 | 12.99 |
| 29 | 28.98 | — |
| 30 | −11.36 | — |
| 31 | 44.32 | −12.68 |

It is seen that a scale 86 which is forty-three cents flat will reduce the error in harmonics 7, 11, 13, 14, 21, 22, 25, 26, 28 and 31 to a reasonable value.

For reproduction of a good pipe organ tone, thirty-two harmonics are considered highly desirable, so long, of course, as the harmonics are within the audible range. However, it will be appreciated a greater or lesser number can be utilized if so desired. In any case, once the pattern of harmonics is established, this pattern holds substantially true for all notes. That is, corresponding harmonics 7, 11, 13, 14, 21, 22, 25, 26, 28 and 31 are produced by generators in the second group of tone generators regardless of the location along the scale of the particular note being played, and the remaining harmonics are produced by generators of the first group. The displacements from the fundamental up the scales to the generators producing the various harmonics remain substantially the same for any note played.

It is noted the generators 43–58 are divided into sub groups 43–50 and 51–58, respectively supplying their outputs to summing circuits 68 and 70. The frequency ranges represented by these sub groups correspond to those of tone generators already feeding summing circuits 68 and 70. Each of the generators 43–58 receives data bus and strobe inputs from buses 18 and 24 respectively, and may comprise the same general type of unit as the generators of the first mentioned group. That is, generators 43–58 may comprise individual oscillators for generating the respective notes of a second scale, but preferably comprise digital gating means receiving a digital chopping input from master generator 64. The latter comprises a top octave generator supplying its output frequencies to scale generators 43–54, and divided-down frequency inputs to lower octaves.

The generators in the two groups feeding a common summation circuit 68 or 70 are collected in groups of 16, but it is understood a greater or lesser number can be similarly collected if desired. It is preferred that approximately 16 to 24 tone generators feed a common summation circuit. With the filtering arrangement disclosed, all harmonics are reduced by more than 50 db compared with the fundamental.

FIG. 3 illustrates a keyboard input circuit which comprises a plurality of switches 88 each representing a key operated or stop operated switch on keyboard 10. The switches are grouped in groups of eight and are connected through diodes 90 to eight drivers 92 supplying an input to microprocessor 12. Bus 93 represents a microprocessor output port which sequentially energizes leads 94, 96, 96, etc., for empowering the respective groups of eight switches. Bus 99 represents a microprocessor input port which is used to sense the status of the particular eight switches of keyboard 10 selected according to the data on bus 93.

Typically, the positions of switches 88 are read as described above and compared with previous positions as stored in random access memory 16. Each time there is a switch change, the new condition thereof is stored in memory, and the microprocessor either changes the contents of the voicing portions of random access memory 16 in the case of a stop change, or presents appropriate outputs to the tone generators in the case of any key depression or release. In the case of a key actuation, the appropriate harmonic tone generators are activated to reproduce the correct note and voice.

As hereinafter more fully described, for a given key-down position the microprocessor accesses from read only memory 14 the location of the particular tone generator which will produce the fundamental for that note, and then identifies the tone generators which will produce the various harmonics. The microprocessor also accesses the amplitude of the fundamental and the amplitude of the various harmonics from the voicing portion of random access memory 16 for the division in which the depressed key is located. The amplitudes of fundamental and harmonics are added (preferably in RMS fashion) to the respective amplitude of any outputs which the selected tone generators were already producing, these latter values being stored in RAM memory. The result of such addition will be output on data bus 18, while the selection of the generators is coordinately implemented via address bus extension 24.

Referring to FIG. 4, one form of the generator is illustrated. The tone generator may be described as a digital-to-analog converter receiving a first input from microprocessor data bus 18 and a second input from address bus extension 24' comprising the output of AND gate 100 forming part of address matrix 22. The principal component comprises eight bit CMOS latch 102 which is suitably a National 74C373 latch for receiving digital input via the data bus and latching the same in place when strobed at lead 24'. When turned on, the latch holds information, representing e.g. the amplitude of a fundamental or harmonic component, until the information is changed. The output of the latch is coupled to an R-2R network 104 which converts the digital output to an analog value in a known manner. The analog output is applied via lead 106 to chopping circuit or switch 108, the chopping drive input of which is typically received from the divider chain 62 from a master top octave generator 60 (or 64) in FIG. 1. The switch 108 thus supplies an output on lead 110 having an amplitude corresponding to the input provided at 106, and chopped at the frequency derived from the divider chain. Switch 108 may comprise a transistor having its collector connected to lead 106, its base connected to divider chain 62, its emitter grounded and its collector providing the output at 110 for application to a summing circuit.

An alternative and preferred embodiment of the tone generator is illustrated in FIG. 5, which operates in the same manner as the FIG. 4 circuit except that the divider chain input 62 is applied to the tri-state enable connection of the latch. The tri-state enable lead repetitively raises all the output leads to a high impedance condition which essentially provides a grounded output in the circuit at such times. Thus, a specific chopping circuit is unnecessary.

A third embodiment of a tone generator is illustrated in FIG. 6 and comprises an individual oscillator 112 tuned to the appropriate frequency for the generator. The output of the oscillator is coupled through a multiplier or modulator 114 which then supplies the oscillator output on lead 116 in accordance with the modulation value derived from data bus 18. The multiplier or modulator 14 suitably includes a CMOS latch, of the same type illustrated in the embodiment of FIG. 4 or the embodiment of FIG. 5, for receiving a digital value from the data bus and supplying an analog output. This analog output is in turn coupled to an analog modulator or multiplier receiving the output of oscillator 112 and varying the amplitude thereof in accordance with the modulation indicated.

FIG. 7 illustrates an address matrix 22 comprising a pair of 4 to 16 line decoders 118 and 120 respectively having their four input leads connected to four separate lines of address bus 20. For each unique binary input applied to the decoder 118 or the decoder 120, such decoder supplies one unique output on one of its 16 output lines, when strobed at 122 or 124 respectively by the microprocessor. Therefore, for a given address on address bus 20, one junction between the decoder output lines in matrix 22 will have both lines energized. At each junction of two matrix conductors, e.g. conductors 126 and 128, an AND gate 100 is located receiving its respective inputs from the two conductors. When both conductors are energized, the AND gate enables its output lead 24' for strobing a respective tone generator. As hereinbefore described, when the tone generator is strobed, the harmonic amplitude information therefor is latched from data bus 18.

Since there are 256 crossovers in the matrix of FIG. 7, then 256 latches can be addressed for a similar number of tone generator ports. However, a smaller or larger number of tone generators may be employed, for example typically 150 in a small organ including 61 to 85 for the first group and the remainder for the second or offset group. The second or offset group can employ fewer generators at the lower end of the scale inasmuch as at the extreme low end of the scale the second group is typically not called upon to provide harmonic content. The second group of generators may include generators of higher frequency than the first group for the purpose of providing higher harmonics.

Alternatively, three or more groups of tone generators can be employed representing chromatic scales which are offset in frequency by a slightly lesser amount than the two scales discussed herein, for more closely approximating harmonic tones. Two groups of generators are illustrated herein by way of example.

Although the outputs of summation circuits such as 68 and 70 are shown as being coupled to a common summation circuit 76 through intermediate filters, it is desirable in many cases to provide a plurality of output summation circuits 76 driving audio reproduction apparatus for different frequency ranges. Thus, summation circuits exemplified by elements 68 and 70 may be collected in groups of fours with the top four along the scale feeding a common summation circuit for operating a high frequency speaker, with the lower four along the scale driving a low frequency speaker, and remaining groups driving intermediate range audio reproduction apparatus. Alternatively, connections such as indicated at 83 according to the alternative embodiment of FIG. 10 may be employed. Thus, summation circuits exemplified by elements 68 and 70 may be collected in groups of four interconnected by connections 83. The top element of the group (such as element 68) will drive a filter and appropriate range audio reproduction apparatus.

Figure 8:
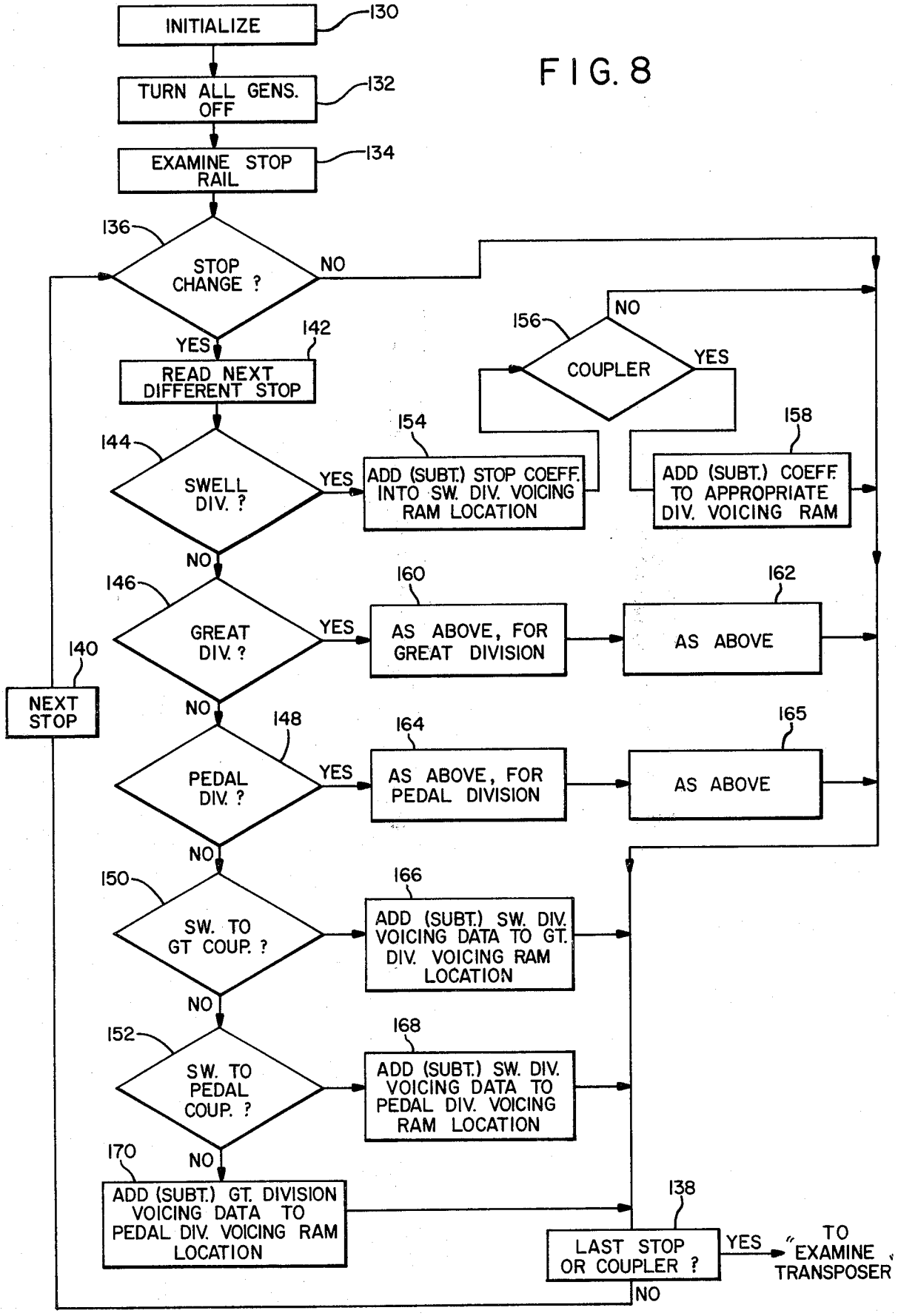
FIGS. 8 and 9 are flow diagrams illustrating programming for the microprocessor employed in the FIG. 1 tone generating system.
Figure 9:
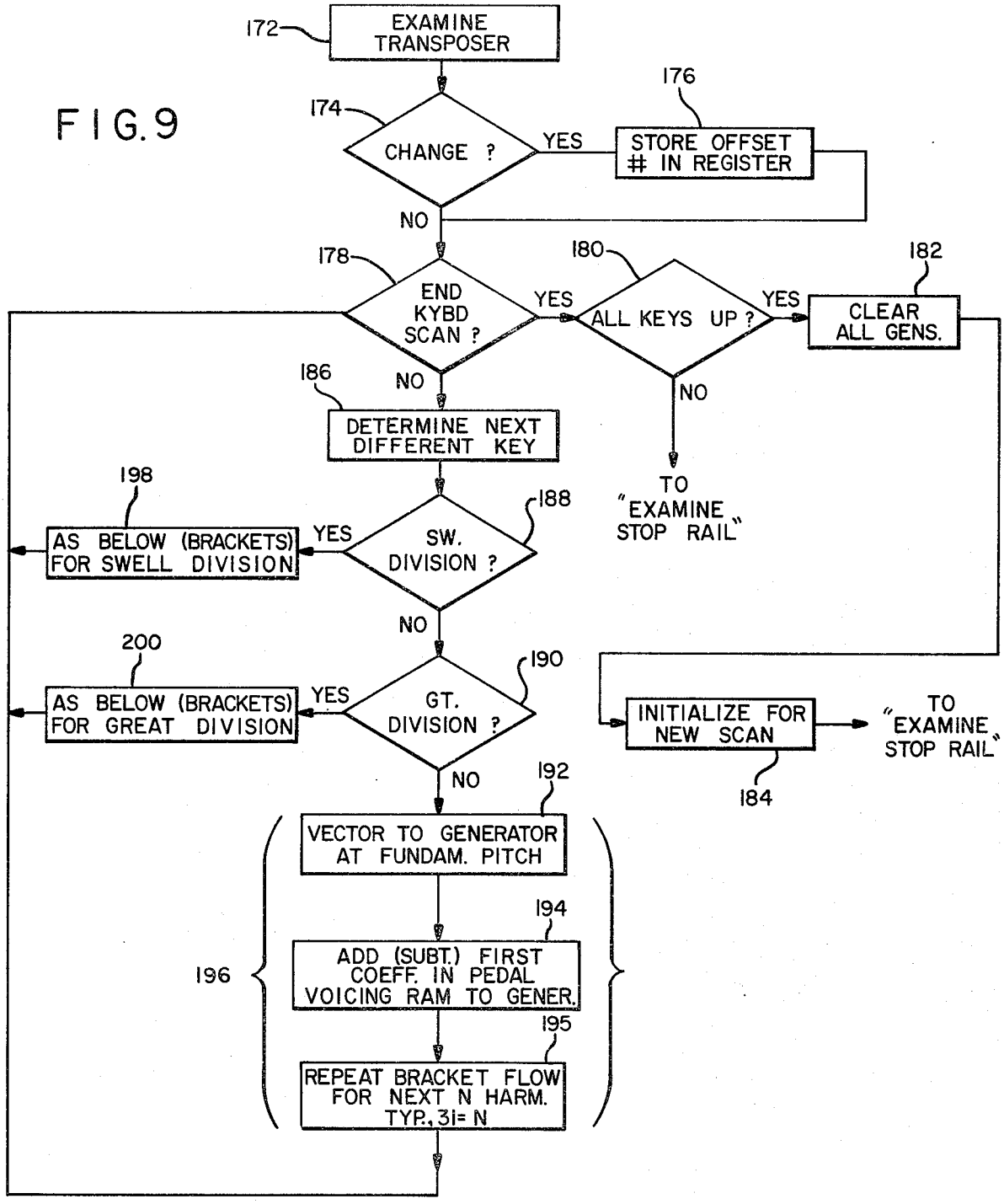

The microprocessor 12 is programmed in the manner indicated by the flow charts of FIG. 8 and FIG. 9. Referring first to FIG. 8, the first or initialize step 130 clears the random access memory, sets the transposer (not shown) of the organ to zero, turns the stops including the couplers off, and all tone generators are turned off as further indicated by step 132. According to step 134, the "stop rail", i.e. all the stop switches including coupler and other control switches, are examined to see if any such switches are depressed. If there are no changes, the program proceeds according to step 136 to last step 138 to ascertain whether the last stop or coupler on the stop rail has been examined. If the answer is no, the next stop is examined in step 140 with return to decision step 136. If there is a stop change, then the stop is read according to step 142 and it is determined in successive decision steps 144, 146, 148, 150 and 152 whether the stop is in the swell division, great division, pedal division, and whether it is a swell to great coupler or swell to pedal coupler. If there is a stop change and none of these decisions are true, then presumably a great to pedal coupler has been actuated. As hereinbefore indicated, comparison is made between new and stored stop positions to determine if there are "stop changes".

If a swell division stop has been actuated (or deactuated), the appropriate stop coefficients for appropriate harmonics as found in ROM are added to or subtracted from the voicing RAM location for the swell division in RAM. If a coupler was theretofore actuated, as detected in step 156, then coefficients are added to or subtracted from the appropriate divisional voicing RAM location to update intermanual coupling. Thus, if the swell to great coupler was on, then the new stop information for the swell division is added to the great division voicing RAM location as indicated in step 158. After step 158, or in the event no coupler is actuated, return is made to step 138.

If step 146 indicates a great division stop, the procedure is identical in steps 160 and 162, except as pertaining to the great division. Similarly, blocks 164 and 165 indicate an identical operation for the pedal division.

If none of the stops have changed position, then the "stop" must constitute a coupler. If the swell to great coupler is actuated, detection thereof in step 150 leads to step 166 wherein the swell division voicing data is added to or subtracted from the great division voicing RAM location. If change in operation of the swell to pedal coupler is detected in step 152, then the swell division voicing data is added to or subtracted from the pedal division voicing RAM location. If neither the swell to great coupler nor the swell to pedal coupler has changed then a great to pedal coupler to presumed altered and the great division voicing data is added to or subtracted from the pedal division voicing RAM location in step 170. Return to step 138 is made from the last three coupler sequences.

If the last stop or coupler has not been read, then the above procedure repeats as indicated. If the last stop or coupler has been read, the program proceeds to "examine transposer" in FIG. 9. The preceeding sequence is for bringing the RAM voicing portions up-to-date.

The transposer, not physically illustrated herein, can simply comprise a computer function wherein the actuation of a key on the keyboard provides an offset result, either up or down the keyboard, in accordance with appropriate input information provided the computer. In step 172 in FIG. 9, the input transposition information is examined, and if a change is detected in step 174, the indicated offset is stored in a RAM register so as to "transpose" key actuation information up or down the scale by the predetermined number of notes.

Following this, step 178 asks whether the keyboard scan is ended, and if this is true, step 180 determines whether all keys are up. If they are not, return is made to the "examine stop rail" procedure of FIG. 8. If the keys are all up, step 182 clears all generators, and the following step 184 initializes for a new scan with return to "examine stop rail" in FIG. 8. If the keyboard scan has not ended in step 178, then step 186 determines the next different key the condition of which has changed. Thus, newly input key condition information is compared with key positions stored in RAM and the comparison results in segregation of change information.

Steps 188 and 190 determine whether the key information pertains to the swell division or the great division. If the answer to both of these questions is no, then the key change input must pertain to the pedal division and accordingly the procedure bracketed at 196 is carried out. In step 192, entitled "Vector to Generator at Fundamental Pitch", the read only memory is accessed to determine the particular one of the tone generators of the first group of tone generators (26 through 41 . . . in FIG. 1) which should be actuated to provide the fundamental tone for the selected note. The correct address bus information is thereby determined for strobing one of the tone generators.

Step 194 adds or subtracts the first coefficient (fundamental) accessed from the pedal voicing RAM location to amplitude information previously stored in RAM for the selected tone generator. Thus, the fundamental amplitude coefficient is first accessed from the pedal voicing RAM location and added, preferably in RMS fashion, to information in RAM indicating the amplitude theretofor supplied to the same tone generator. The new information is stored in RAM and provided on the data bus, while the strobing information derived in step 192 is supplied to the address bus for causing the selected tone generator to be "reprogrammed" to the new amplitude value. Assuming the selected tone generator was previously non-actuated, it will now contain and generate only the fundatmental tone for the depressed actuated key. Of course, if the key is "changed" by virtue of its no longer being actuated, the operation of the tone generator is changed in a subtractive sense.

In step 195, the same procedure (as in steps 192 and 194) is then repeated for the next thirty-one harmonics, with access to the ROM to find out which generators are to be operated from which group. An addition is made to determine the particular one of the tone generators in the first group which should be operated to provide the second harmonic for a selected note. In the case of the second harmonic, the tone generator will be a thirteenth tone generator up the scale in the first group (the octave) as indicated by FIG. 2. The correct address bus information is obtained for strobing the thirteenth generator. The second harmonic amplitude coefficient is also accessed from the pedal voicing RAM location and added (or subtracted), preferably in RMS fashion, to information in the RAM indicating the amplitude theretofore supplied to the thirteenth tone generator. The new information is stored in RAM and supplied on the data bus as the correct generator is strobed. This procedure is repeated for each harmonic through the sixth harmonic whereby selected tone generators in the first group are reprogrammed to a new amplitude value. The position of each harmonic on the scale is calculated, i.e. the third harmonic is the twentieth note up the scale, the fourth harmonic is the twenty-fifth note up the scale, etc., as would be indicated by the closest match according to Table I. In the case of the seventh harmonic, step 192 accesses from ROM the indication that a tone generator of the second group of tone generators (43 through 58. . . , in FIG. 1) should be actuated to provide the seventh harmonic tone for the selected note, and its location up the scale is calculated, i.e. the thirty-fifth note up the second group is selected, since it is predetermined (in accordance with the Table I) that this note will provide the closest match to the seventh harmonic. Again step 194 adds or substracts the seventh harmonic coefficient accessed from the pedal voicing RAM location to amplitude information previously stored in RAM for the identified tone generator. The procedure repeats as above, through thirty-two harmonics in the specific example, with tone generators from either the first group or the second group being operated, in accordance with information stored in ROM, to provide the closest match. After step 195, return is made to decision 178.

If the decision in step 188 or 190 had been that a changed key condition was from the swell or great division respectively, then step 198 or step 200 would have applied. In either case, the same procedure as bracketed at 196 is carried out, except it would be for the swell division or great division. The procedure accesses fundamental and harmonic amplitude coefficients respectively from the swell voicing RAM location or the great voicing RAM location. The routine of FIG. 9 is then repeated for implementing the actuation (or deactuation) of tone generators in response to changes in keyboard key positions until the end of a keyboard scan is detected in step 178, and a return is made to the procedure of FIG. 8 for updating the voicing RAM locations in accordance with stop rail changes. It will be appreciated the speed of implementation of these procedures by a microprocessor is such that a note is generated by the instrument in substantially immediate response to a keyboard change, and likewise a change in tonal quality addressed by changes in stop positions takes place substantially immediately.

While I have shown and described several embodiments of my invention, it will be apparent to those skilled in the art that many changes and modifications may be made without departing from my invention in its broader aspects. I therefore intend the appended claims to cover all such changes and modifications as fall within the true spirit and scope of my invention.

I claim:

1. An electronic tone generating system of the harmonic synthesis type for generating complex tones each including a fundamental and a series of harmonics, said system comprising:

a keyboard, a first group of tone generators having first output frequencies defining a first musical scale, wherein given tone generators are selected in response to said keyboard for providing tones by harmonic synthesis by providing fundamental output frequencies corresponding to notes indicated by actuation of keys of said keyboard and a first set of harmonic output frequencies corresponding to notes indicated by actuation of keys of said keyboard within predetermined frequency error limits for given harmonics, the same tone generators in said first group along said first musical scale serving selectively to provide individual harmonic and fundamental frequencies according to the keyboard keys operated, such that the same tone generator in said first group as supplies a fundamental output for a given actuated key along the scale is also selectable by a lower actuated key along the same scale to supply a harmonic output for said lower actuated key along the same scale, and a second group of tone generators having second output frequencies defining a second musical scale offset from said first musical scale, wherein given tone generators of said second group are selected in response to said keyboard for providing a second set of harmonic output frequencies corresponding to said notes indicated by actuation of keys of said keyboard in the tone generation by harmonic synthesis for substituting for harmonic output frequencies of said first set falling outside said predetermined error limits for given harmonics.

2. The system according to claim 1 wherein said tone generators comprise separate oscillators wherein the oscillators of said first group are tuned to notes defining said first musical scale and the oscillators of said second group are tuned to notes defining said second offset musical scale.

3. The system according to claim 1 wherein said tone generators comprise latching circuits operated in response to actuation of said keyboard and including means for chopping the output of a said latching circuit at a frequency according to the respective musical scale represented thereby.

4. The system according to claim 3 wherein said latching circuits latch values representing the amplitude outputs of given tone generators.

5. The system according to claim 3 including top octave master generators for said respective musical scales, with generators of said first group receiving divided-down chopping signals from a first top octave master generator and generators of said second group receiving divided-down chopping signals from a second top octave master generator.

6. The system according to claim 1 including a computer operated in response to actuation of said keyboard and programmed to operate selected tone generators for providing a given note output according to a known voice harmonic content.

7. The system according to claim 6 wherein said computer is provided with a memory storing locations of tone generators in said first group appropriate to provide respective fundamental output frequencies and relative locations of tone generators in said first and second groups as will provide respective harmonic output frequencies, and means for accessing said memory in response to note selection actuation of said keyboard.

8. The system according to claim 6 including means for controlling the output amplitudes of said tone generators according to said known harmonic content.

9. The system according to claim 6 wherein said computer is provided with a memory for storing the output amplitudes of respective harmonics, and means for accessing said memory for determining said output amplitudes.

10. The system according to claim 6 wherein said computer is provided with a memory for storing amplitude values for operated tone generators, said computer including means for adding new amplitude values for a newly selected note to stored amplitude values for corresponding tone generators, and means for actuating said tone generators according to the added values.

11. The system according to claim 6 further including a plurality of stops wherein said computer receives additional input indicative of acutation of said stops, said computer being responsive to actuation of said stops to control output amplitudes of said tone generators according to the harmonic content of a selected note, including the addition of stop information selected by individual stops.

12. The system according to claim 11 wherein said addition of stop information comprises RMS addition.

13. The system according to claim 11 wherein said computer is provided with a memory including portions for storing harmonic component amplitude values corresponding to the stops actuated, said addition comprising addition of harmonic component amplitude values already stored in memory to harmonic component amplitude values corresponding to newly actuated stops.

14. The system according to claim 11 wherein said computer is provided with a memory for storing amplitude values for operated tone generators, said computer including means for adding new amplitude values for a newly selected note to stored amplitude values for corresponding tone generators, and means for actuating said tone generators according to the added values.

15. The system according to claim 14 wherein such addition of new amplitude values for a newly selected note to stored amplitude values comprises RMS addition.

16. The system according to claim 1 further including plural summing means for receiving the outputs of said tone generators in said first and second groups according to the frequencies of their outputs wherein a given summing means receives tone generator outputs over a selected frequency range, and low pass filter means receiving the output of each summing means for removing undesired harmonics.

17. The system according to claim 16 further including summing means for receiving the outputs of said filter means and providing an overall output.

18. The system according to claim 16 wherein the summing means for a given frequency range also receives the output of a said filter means for the next lower frequency range.

19. The system according to claim 16 or claim 18 further including means for receiving the outputs of selected filters according to frequency for providing separate channel audio outputs.

20. An electronic tone generating system of the harmonic synthesis type for generating complex tones each including a fundamental and a series of harmonics, said system comprising:

a keyboard comprising a plurality of keys corresponding to notes of a first musical scale, a first group of tone generators defining by their output frequencies the fundamentals of notes of the same musical scale as said keyboard wherein a given tone generator is selected in response to operation of a corresponding note key to produce the fundamental output frequency of the note selected by the key, and wherein other of said tone generators of said first group along the same musical scale are selected in response to operation of the same key to produce tone generation by harmonic synthesis by respectively providing harmonic components of the selected note according to the harmonic content thereof within predetermined frequency error limits for given harmonics, the same tone generators in said first group along said musical scale serving selectively to provide individual harmonic and fundamental frequencies according to the keyboard keys operated, such that the same tone generator in said first group as supplies a fundamental output for a given actuated key along said scale is also selectable by a lower actuated key along the same scale to supply a harmonic output for said lower actuated key along the same scale, and a second group of tone generators defining by their output frequencies the notes of a second musical scale offset from the musical scale of said keyboard wherein tone generators of said second group along said second musical scale are responsive to the operation of the said same key to produce other harmonic components of the selected note in the tone generation by harmonic synthesis by substituting for harmonic components of the first scale falling outside said predetermined error limits for given harmonics.

21. The system according to claim 20 including a computer operated in response to actuation of said keyboard and programmed to operate selected tone generators for providing a given note output according to a known voice harmonic content.

22. The system according to claim 21 wherein said computer is provided with a memory storing locations of tone generators in said first group appropriate to provide respective fundamental output frequencies and relative locations of tone generators in said first and second groups as will provide respective harmonic output frequencies, and means for accessing said memory in response to note selection actuation of said keyboard.

23. The system according to claim 21 including means for controlling the output amplitudes of said tone generators according to said known harmonic content.

24. The system according to claim 21 wherein said computer is provided with a memory for storing the output amplitudes of respective harmonics, and means for accessing said memory for determining said output amplitudes.

25. The system according to claim 21 wherein said computer is provided with a memory for storing amplitude values for operated tone generators, said computer including means for adding new amplitude values for a newly selected note to stored amplitude values for corresponding tone generators, and means for actuating said tone generators according to the added values.

26. The system according to claim 21 further including a plurality of stops wherein said computer receives additional input indicative of actuation of said stops, said computer being responsive to actuation of said stops to control output amplitudes of said tone generators according to the harmonic content of a selected note, including the addition of stop information selected by individual stops.

27. The system according to claim 26 wherein said addition of stop information comprises RMS addition.

28. The system according to claim 26 wherein said computer is provided with a memory including portions for storing harmonic component amplitude values corresponding to the stops actuated, said addition comprising addition of harmonic component amplitude values already stored in memory to harmonic component amplitude values corresponding to newly actuated stops.

29. The system according to claim 26 wherein said computer is provided with a memory for storing amplitude values for operated tone generators, said computer including means for adding new amplitude values for a newly selected note to stored amplitude values for corresponding tone generators, and means for actuating said tone generators according to added values.

30. An electronic tone generating system comprising:

a keyboard comprising a plurality of key operated switches representing the notes of a musical scale, a computer operated by said keyboard as an input device and responsive to a change in key condition for identifying a fundamental amplitude and the amplitude of a plurality of harmonic components according to generation of a selected note by harmonic synthesis indicated by a changed key condition, and a plurality of substantially independently operable tone generators each receiving a digital input from said computer for producing an analog output waveform representing a separate note on a musical scale, the outputs of said plurality of tone generators defining said musical scale, said computer being programmed to respond to a changed key condition representative of a selected note for operating a group of tone generators among said plurality of tone generators at selected individual waveform envelope amplitudes according to the notes along said musical scale corresponding within predetermined error in frequency to the fundamental and harmonic components of said selected note as will generate said selected note by harmonic synthesis, wherein the same tone generators along said scale serve selectively to provide individual harmonic and fundamental frequencies according to keyboard keys operated, such that the same tone generator as supplies a fundamental output for a given actuated key along the scale is also selectable by a lower actuated key along the scale to supply a harmonic output.

31. The systen according to claim 30 wherein said plurality of substantially independently operable tone generators are provided frequency inputs from a divider chain.

32. The system according to claim 30 wherein each said tone generator includes a latching circuit for receiving a digital input from said computer representative of amplitude value and for storing said value, and an individual tone oscillator having its output modulated by said stored value.

33. The system according to claim 30 wherein said computer includes memory means accessed by said computer for identifying said fundamental amplitude and amplitudes of a plurality of harmonic components.

34. The system according to claim 33 wherein said keyboard further includes stop means and said computer is responsive to a change in condition of said stop means for altering information stored in said memory means for identifying said fundamental amplitude and amplitudes of a plurality of harmonic components.

35. An electronic tone generating system comprising:

a keyboard comprising a plurality of key operated switches representing the notes of a musical scale, a stored program computer operated by said keyboard as an input device, a plurality of substantially independently operable tone generators, each receiving a digital input from said computer for producing an analog output and each representing a different tone along a musical scale, said computer being programmed to respond to a changed key condition representative of a given note for selecting a group of tone generators from among said plurality of tone generators to represent the fundamental and possible harmonic components of said given note, a plurality of stops wherein said computer receives additional input indicative of actuation of said stops, said computer being responsive to actuation of said stops for controlling the relative amplitudes as between tones produced by said tone generators of said selectively operated group of tone generators to provide a harmonic content for a given note as determined by said stops, including the addition of amplitude value stop information dictated by actuation of individual stops, and means responsive to actuation of said tone generators to produce an audio output for reproducing a given note by harmonic synthesis.

36. The system according to claim 35 wherein said tone generators comprise separate oscillators and wherein the oscillators are tuned to notes defining said musical scale.

37. The system according to claim 35 wherein said computer is provided with a memory including portions for storing harmonic component amplitude values corresponding to the stops actuated, said addition comprising addition of harmonic component amplitude values already stored in memory to harmonic component amplitude values corresponding to newly actuated stops.

38. An electronic tone generating system comprising:

a keyboard, a plurality of tone generators for individually providing outputs having frequencies defining a chromatic scale, a computer operated in response to actuation of said keyboard and programmed to operate selected of said tone generators for providing a given note output by harmonic synthesis according to the harmonic content of that note, with each selected tone generator providing a different fundamental or harmonic component for that note, said tone generators comprising latching circuits which are operated in response to actuation of said keyboard and including means for chopping the outputs of said latching circuits at selected fundamental or harmonic frequencies, a plurality of stops wherein said computer receives additional input indicative of actuation of said stops, said computer being responsive to actuation of said stops for controlling the amplitude outputs of individual tone generators according to the relative amplitude values of different harmonic components of a selected note as determined by said stops, including the addition of stop information selected by individual stops, and means responsive to actuation of said tone generators to produce an audio output.

39. The system according to claim 38 including a top octave master generator, with tone generators receiving divided-down chopping signals from said top octave master generator.

40. An electronic tone generating system comprising:

a keyboard, a first plurality of tone generators for individually providing outputs having frequencies defining a chromatic scale, a computer operated in response to actuation of said keyboard and programmed to operate selected of said tone generators for providing a given note output by harmonic synthesis according to the harmonic content of that note, with each selected tone generator providing a different fundamental or harmonic component for that note, a second plurality of tone generators for individually providing outputs having frequencies defining a second chromatic scale, said computer being programmed to operate selective of said tone generators of said second plurality to provide predetermined harmonic components of the selected note substituting for tone generators of said first plurality of tone generators to provide said harmonic components within predetermined error, the pattern of tone generators from said first and second pluralities of tone generators selected to produce a given note defining a substantially constant displacement pattern relative to the fundamental along said musical scales regardless of the particular note selected on said keyboard, a plurality of stops wherein said computer receives additional input indicative of actuation of said stops, said computer being responsive to actuation of said stops for controlling the amplitude outputs of individual tone generators according to the relative amplitude values of different harmonic components of a selected note as determined by said stops, including the addition of stop information selected by individual stops, and means responsive to actuation of said tone generators to produce an audio output.

41. An electronic tone generating system comprising:

a keyboard comprising a plurality of key operated switches representing the notes of a musical scale, a stored program computer operated by said keyboard as an input device, and a plurality of substantially independently operable tone generators, each representing a different tone along a musical scale and each comprising a digital to analog converter for receiving a digital input from said computer, said computer being programmed to respond to a changed key condition representative of actuation of a given note for selectively operating a group of tone generators from among said plurality of tone generators at selected individual envelope amplitudes to represent the fundamental and predetermined harmonic components of said given note for reproducing said given note by harmonic synthesis.

42. An electronic tone generating system comprising:

a keyboard comprising a plurality of key operated switches representing the notes of a musical scale, a computer operated by said keyboard as an input device and responsive to a change in key condition for identifying a fundamental amplitude and the amplitude of a plurality of harmonic components corresponding to generation of a selected note by harmonic synthesis indicated by a changed key condition, a first plurality of substantially independently operable tone generators each receiving a digital input from said computer for producing an analog output waveform representing a separate note on a musical scale, said tone generator outputs as a group defining said musical scale, said computer being programmed to respond to a changed key condition for operating individual tone generators of said group of tone generators at selected waveform envelope amplitudes according to the notes along said musical scale corresponding within predetermined error in frequency to the fundamental and harmonic components of a selected note, and a second plurality of tone generators for individually providing outputs defining a second musical scale offset from the first mentioned musical scale, said computer being programmed to operate ones of said tone generators of said second plurality to provide predetermined harmonic components of a selected note within predetermined error in frequency and at said identified fundamental and harmonic amplitudes, the pattern of tone generators from said first and second pluralities of tone generators selected to produce a given note defining a substantially constant displacement pattern relative to a fundamental along each said musical scale regardless of a particular note selected by a key of said keyboard for generating said selected note by harmonic synthesis.

43. An electronic tone generating system comprising:

a keyboard comprising a plurality of key operated switches representing the notes of a musical scale, a computer operated by said keyboard as an input device and responsive to a change in key condition for identifying a fundamental amplitude and the amplitude of a plurality of harmonic components corresponding to generation of a selected note by harmonic synthesis indicated by a changed key condition, and a plurality of substantially independently operable tone generators each receiving a digital input from said computer for producing an analog output waveform representing a separate note on a musical scale, said tone generator outputs as a group defining said musical scale, said computer being programmed to respond to a changed key condition for operating individual tone generators of said group of tone generators at selected waveform envelope amplitudes according to the notes along said musical scale corresponding within predetermined error in frequency to the fundamental and harmonic components of a selected note as will generate said selected note by harmonic synthesis, wherein each said tone generator includes a latching circuit for receiving a digital input from said computer representative of amplitude value and for storing said value, and an analog output network for converting the stored value to an analog output level for said tone generator.

44. The system according to claim 43 wherein said latching circuit comprises a CMOS latch provided with a digital input from a data bus output from said computer, said output network comprising a resistive network receiving the latched output of said CMOS latch to provide an analog level, and wherein a strobe input for said CMOS latch is provided from an address bus output of said computer to energize said latch.

45. The system according to claim 44 further including a chopping switch receiving said analog level for chopping the same at the predetermined frequency of said tone generator.

46. The system according to claim 45 wherein a chopping input for said chopping switch is provided from a divider chain.

47. The system according to claim 44 wherein said CMOS latch includes a tri-state enable input and further including chopping input means connected to the tri-state enable input of said latch for chopping the output of said latch at the predetermined frequency of said tone generator.

48. The system according to claim 47 wherein said chopping input means comprises a divider chain.

* * * * *